US008133022B2

(12) United States Patent
Yoshida et al.

(10) Patent No.: US 8,133,022 B2
(45) Date of Patent: Mar. 13, 2012

(54) AXIAL FAN AND FRAME THEREOF

(75) Inventors: Yusuke Yoshida, Kyoto (JP); Hidenobu Takeshita, Kyoto (JP); Hidefumi Kawakami, Kyoto (JP)

(73) Assignee: Nidec Corporation, Kyoto (JP)

( * ) Notice: Subject to any disclaimer, the term of this patent is extended or adjusted under 35 U.S.C. 154(b) by 646 days.

(21) Appl. No.: 12/345,864

(22) Filed: Dec. 30, 2008

(65) Prior Publication Data

US 2009/0175720 A1 Jul. 9, 2009

(30) Foreign Application Priority Data

Jan. 4, 2008 (JP) ..... 2008-000032

(51) Int. Cl.
*F01D 1/00* (2006.01)
*F01D 1/04* (2006.01)

(52) U.S. Cl. ..... 415/220

(58) Field of Classification Search ..... 415/220
See application file for complete search history.

(56) References Cited

U.S. PATENT DOCUMENTS

| | | | | |
|---|---|---|---|---|
| 6,491,502 | B2 * | 12/2002 | Hunt | 417/360 |
| 6,617,736 | B1 | 9/2003 | Horng et al. | |
| 7,015,610 | B2 | 3/2006 | Horng et al. | |
| 7,052,236 | B2 * | 5/2006 | Chang et al. | 415/191 |
| 7,306,429 | B2 * | 12/2007 | Horng et al. | 415/210.1 |
| 7,344,358 | B2 | 3/2008 | Lu et al. | |
| 7,442,005 | B2 * | 10/2008 | Yeh et al. | 415/200 |
| 2004/0136830 | A1 * | 7/2004 | Eguchi et al. | 416/228 |
| 2006/0147305 | A1 * | 7/2006 | Horng et al. | 415/220 |

* cited by examiner

*Primary Examiner* — Nitin Parekh
(74) *Attorney, Agent, or Firm* — Keating & Bennett, LLP

(57) ABSTRACT

An axial fan includes a motor section, an impeller, a housing, and a plurality of supporting ribs. The motor section and the impeller are disposed on the inside of the housing. In a connecting region between an inner end portion of the supporting rib and the base section, a first corner portion and a second corner portion are formed on the side of a rotational direction of the impeller and on the side opposite to the rotational direction, respectively. A curvature radius of the first corner portion is larger than a curvature radius of the second corner portion.

20 Claims, 15 Drawing Sheets

A – A

B − B

C − C

AXIAL FAN AND FRAME THEREOF

BACKGROUND OF THE INVENTION

1. Field of the Invention

The present invention relates to an axial fan and a frame thereof.

2. Description of the Related Art

Recently, in conjunction with the improvement in performance of electronic apparatuses, the amount of heat generated from electronic components located in an enclosure of an electronic apparatus goes on increasing. In addition, the size of an enclosure is decreased through the years, so that the density of the electronic components to be arranged in the enclosure also goes on increasing. In such an electronic apparatus, an axial fan is used for cooling and ventilating the inside of the electronic apparatus. In order to improve the cooling characteristics of the axial fan, it is required to increase the rotation speed of an impeller of the axial fan.

The impeller is rotationally driven by a motor. As the rotation speed of the motor is increased, the vibration caused by the rotation is also increased. Accordingly, in order to rotate the motor at a high speed, it is necessary to reduce the vibration or to provide a damping structure. The reduction of vibration can be realized by reducing an unbalance in a rotor section of the motor. For example, in the production of an axial fan, in order to reduce the unbalance, a plurality of components are incorporated. However, in the production of the axial fan, the number of adjusting processes is increased, and the number of processes for managing and assembling the components, so that the productivity may disadvantageously be deteriorated. Thus, it is necessary to improve the vibration characteristics of the axial fan without increasing the number of components.

SUMMARY OF THE INVENTION

In order to overcome the problems described above, preferred embodiments of the present invention provide a frame of an axial fan preferably including a substantially hollow housing arranged to accommodate therein an impeller, a base section, and a plurality of supporting ribs. The base section and the supporting ribs are preferably disposed on the inside of the housing. The supporting ribs extend from the base section to the housing, and support the base section. In a connecting region of the supporting rib and the base section, a first corner portion and a second corner portion are formed on an upstream side and on a downstream side of the rotational direction of the impeller, respectively. A curvature radius of the second corner portion is different from a curvature radius of the first corner portion.

An axial fan in one of preferred embodiments preferably includes a substantially hollow housing, a base section, a plurality of supporting ribs, an impeller, and a motor section. The base section, the supporting ribs, the impeller, and the motor section are preferably disposed on the inside of the housing. The supporting ribs extend from the base section to the housing, and support the base section. The motor section rotationally drives the impeller, and the motor section is supported by the base section. In a connecting region of the supporting rib and the base section, a first corner portion and a second corner portion are formed on an upstream side and on a downstream side of the rotational direction of the impeller, respectively. A curvature radius of the second corner portion is different from a curvature radius of the first corner portion.

Other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
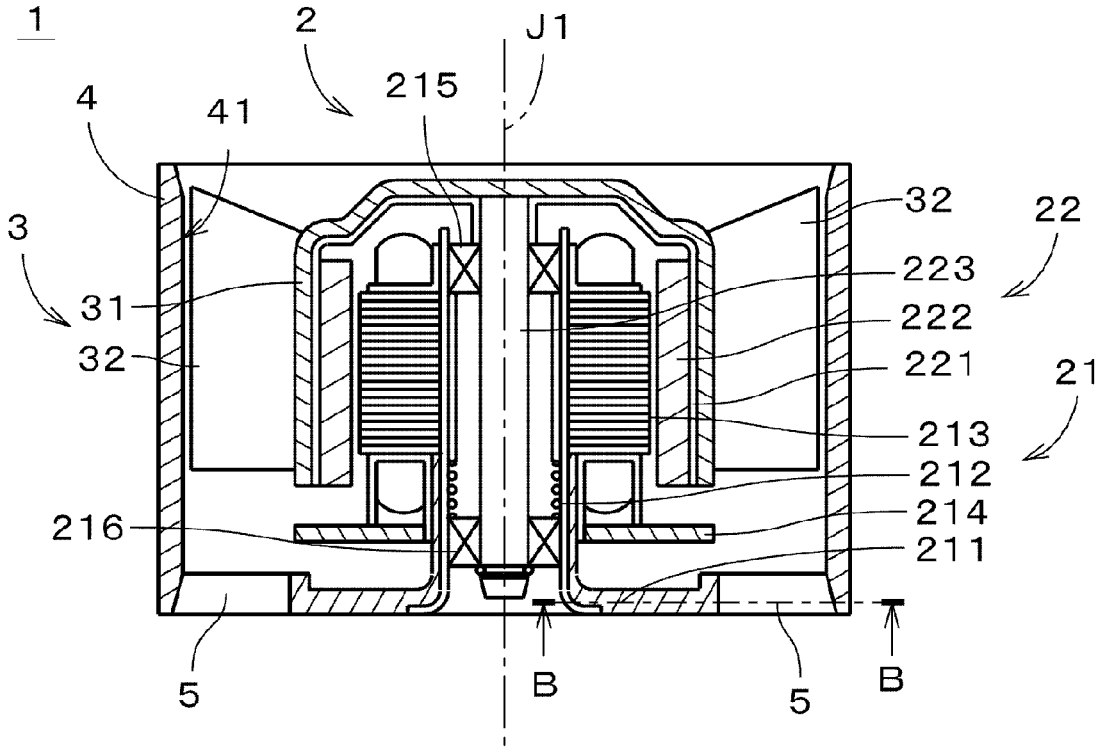
FIG. 1 is a schematic longitudinal sectional view of an axial fan according to a first preferred embodiment of the present invention.

Referring to FIGS. 1 through 15, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

Figure 2:
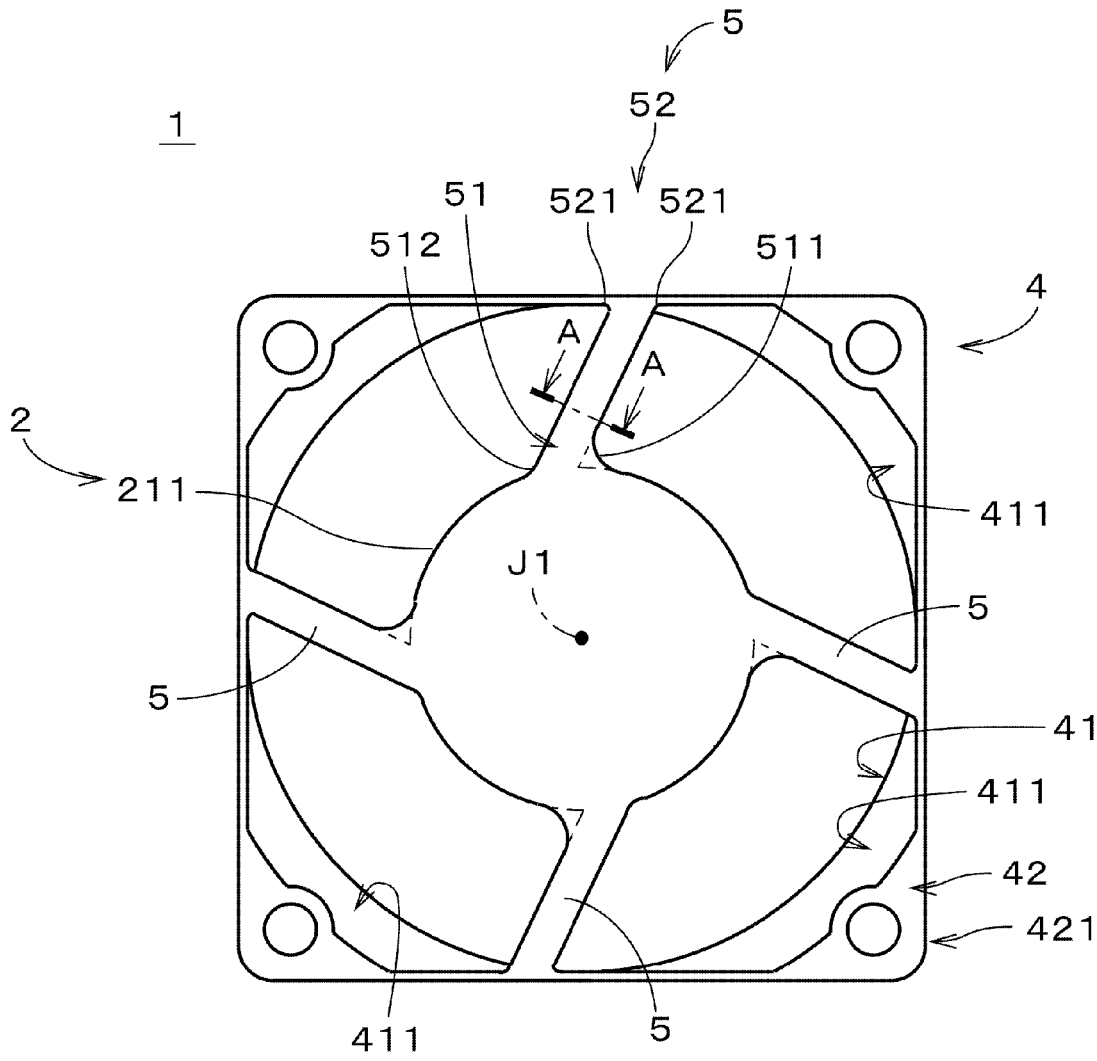
FIG. 2 is a schematic bottom plan view of the axial fan according to the first preferred embodiment of the present invention.

FIGS. 1 and 2 are a longitudinal sectional view and a bottom plan view of an axial fan 1 according to a first preferred embodiment of the present invention, respectively. In FIG. 2, an impeller 3 is not shown. As shown in FIGS. 1 and 2, the axial fan 1 preferably includes a motor section 2, an impeller 3, and a frame. The frame preferably includes a housing 4 and a plurality of supporting ribs (four supporting ribs in the present embodiment).

In the axial fan 1, the impeller 3, the motor section 2, and the supporting ribs 5 are preferably arranged at the inside of the housing 4 which is substantially a hollow member. The supporting ribs 5 preferably extend from an outer periphery of a base section 211 of the motor section 2 to an inner side face 41 of the housing 4, and the supporting ribs 5 are arranged in a circumferential direction, so as to connect the base section 211 to the housing 4 (see FIG. 2).

The impeller 3 preferably includes a substantially cylindrical cup 31 with a cover arranged to cover an outer side of the motor section 2, and a plurality of blades 32 (seven blades in the present preferred embodiment). The blades 32 preferably protrude radially outwards with a center axis J1 as the center from an outer side face of the cup 31, and the blades 32 are arranged evenly apart from one another in a circumferential direction. The cup 31 and the blades 32 are arranged as a single member by a method such as injection molding with a resin, for example. The center axis J1 is also the center of the motor section 2.

The motor section 2 preferably includes a rotor section 22 and a stator section 21. The rotor section 22 is preferably arranged at the upper side above the stator section 21 along the center axis J1. In the rotor section 22, a yoke 221 includes a substantially cylindrical shape with a cover with the center axis J1 as the center. The yoke 221 is preferably made from a metal as a magnetic material, and fixed to an inner side of the cup 31. On the inside of the yoke 221, a field magnet 222 having a substantially cylindrical shape is preferably fixed. At a substantially middle portion of a cover portion of the yoke 221, a shaft 223 is preferably fixed by press fit, for example. The yoke 221 is preferably covered with the cup 31, so that the rotor section 22 is made into an integrated member with the impeller 3.

The stator section 21 preferably includes a bearing holding portion 212 having a substantially cylindrical shape and protruding upwards in an approximately center portion of the base section 211 having a substantially disk-shaped shape. On an outer periphery of the bearing holding portion 212, an armature 213 is preferably attached. The armature 213 is radially opposed to the field magnet 222. On the lower side of the armature 213, a circuit board 214 having a shape of a substantially circular plate is preferably provided. The circuit board 214 is electrically connected to the armature 213 and an external power source (not shown) via a conductive pin (not shown), a lead wire (not shown), for example. The circuit board 214 preferably controls a driving current supplied from the external power source to the armature 213. When a driving current is supplied from the external power source to the armature 213 via the circuit board 214, a torque is generated between the armature 213 and the field magnet 222 with the center axis J1 as the center thereof. Due to the torque, the rotor section 22 rotates relatively to the stator section 21, and airflow from the upper side to the lower side is generated substantially along the center axis J1. On the inner side of the bearing holding portion 212, ball bearings 215 and 216 are disposed in an upper portion and a lower portion in an axial direction, respectively. The ball bearings 215 and 216 rotatably support the shaft 223 inserted into the bearing holding portion 212.

As shown in FIG. 2, an end portion 421 of the housing 4 on an outlet side is substantially square-shaped. At four corners of an inner side face of the end portion 421 (i.e., in a region on the lower side of the inner side face 41 of the housing 4 shown in FIG. 1) inclined faces 411 whose distance from the center axis J1 gradually increases toward a bottom surface 42 are disposed, respectively. Similarly, an end portion on an inlet side (on the upper side of FIG. 1) is substantially square-shaped. On four corners of the inner side face, inclined faces whose distance from the center axis J1 gradually increases toward a top surface are disposed, respectively. The shape of the inclined face is not specifically limited. For example, the shape of the inclined face is a linearly planar shape, or a curved shape.

Figure 3:
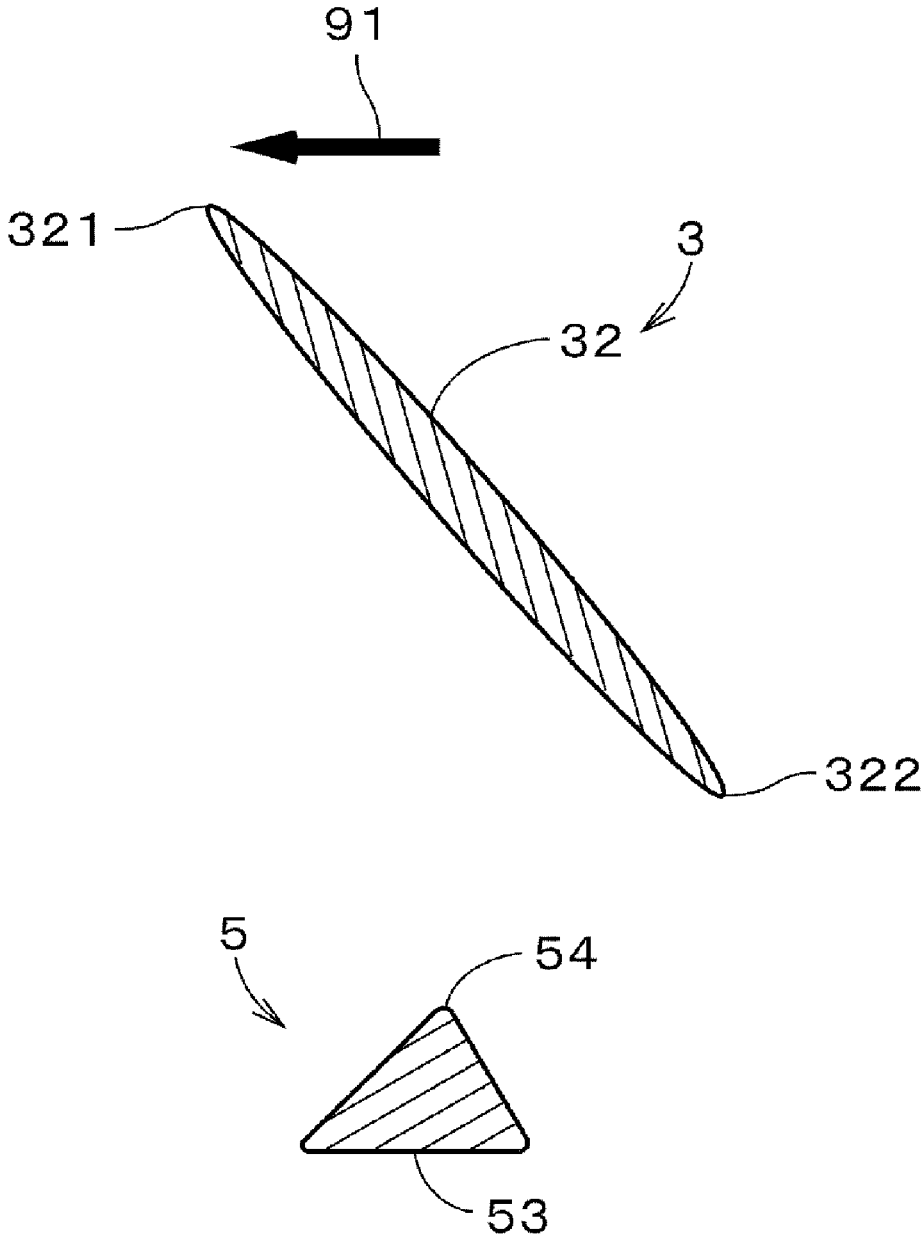
FIG. 3 is a schematic sectional view of a blade and a supporting rib according to the first preferred embodiment of the present invention.

FIG. 3 is a view showing a cross-section of a supporting rig 5 and a blade 32 taken along the line A-A in FIG. 2 (i.e., a section perpendicular to the longitudinal direction of the supporting rib 5). As shown by an arrow 91, the blade 32 of the impeller 3 preferably rotates from the right to the left in FIG. 3 (from the upstream side to the downstream side in the rotational direction). An upper edge 321 of the blade 32 is preferably arranged on the downstream side of the rotational direction (i.e., on the left side of FIG. 3) with respect to the lower edge 322. In accordance with the rotation of the blade 32, the air preferably moves substantially downwards along a surface of the blade.

A sectional shape of the supporting rib 5 is substantially a triangle in which a base thereof is positioned preferably on the lower side. A ridge line 54 and a bottom face 53 preferably correspond to an upper apex and the base of the triangle, respectively. The upper apex (i.e., the ridge line 54) is positioned in a disproportionate manner on the side opposite to the rotational direction of the impeller 3 as compared with the center of the base (i.e., the bottom face 53). A portion of the air generated from the blade 32 flows along the slope on the right side of the supporting rib 5 (on the side opposite to the rotational direction of the impeller 3). Then, the air is preferably sent downwards.

As shown in FIG. 2, the supporting rib 5 preferably extends from the substantially disk-shaped base section 211 of the motor section 2 toward the inner side face 41 of the housing 4. An inner end portion 51 and an outer end portion 52 of the supporting rib 5 are preferably connected to the base section 211 and the inner side face 41, respectively. The respective supporting ribs 5 are preferably inclined on the side (i.e., the upstream side of the rotational direction) opposite to the rotational direction of the impeller (i.e., the counterclockwise direction with the center axis J1 as the center in FIG. 2).

As shown in FIG. 2, when the radial direction is regarded as 0 degree, the angle of inclination of the supporting rib 5 with respect to the radial direction on the basis of the inner end portion 51 preferably falls within such a range that the supporting rib 5 does not correspond to the tangent line of an outer periphery of the base section 211 (i.e., smaller than approximately 90 degrees). In the inner end portion 51 (i.e., in the position where the supporting rib 5 is connected to the outer periphery of the base section 211), a first corner portion 511 and a second corner portion 512 are preferably provided on the side of the rotational direction of the impeller 3 (i.e., the downstream side of the rotational direction), and on the side opposite to the rotational direction (i.e., the upstream side of the rotational direction), respectively. In the present preferred embodiment, the first and second corner portions preferably include an acute angle and an obtuse angle, respectively. In the outer end portion 52 of the supporting rib 5 (i.e., in the position where the supporting rib 5 is connected to the housing 4), third corner portions 521 are preferably provided on the side of the rotational direction of the impeller 3 and the side opposite to the rotational direction, respectively. The housing 4, the supporting ribs 5, and the base section 211 preferably are continuously formed as a single member. For example, the member is formed by injection molding with a resin, or by die-casting utilizing aluminum, aluminum alloy, and the like. Accordingly, when the axial fan 1 is manufactured, an increase in number of components can be prevented so that it is possible to minimize the production cost.

Figure 4:
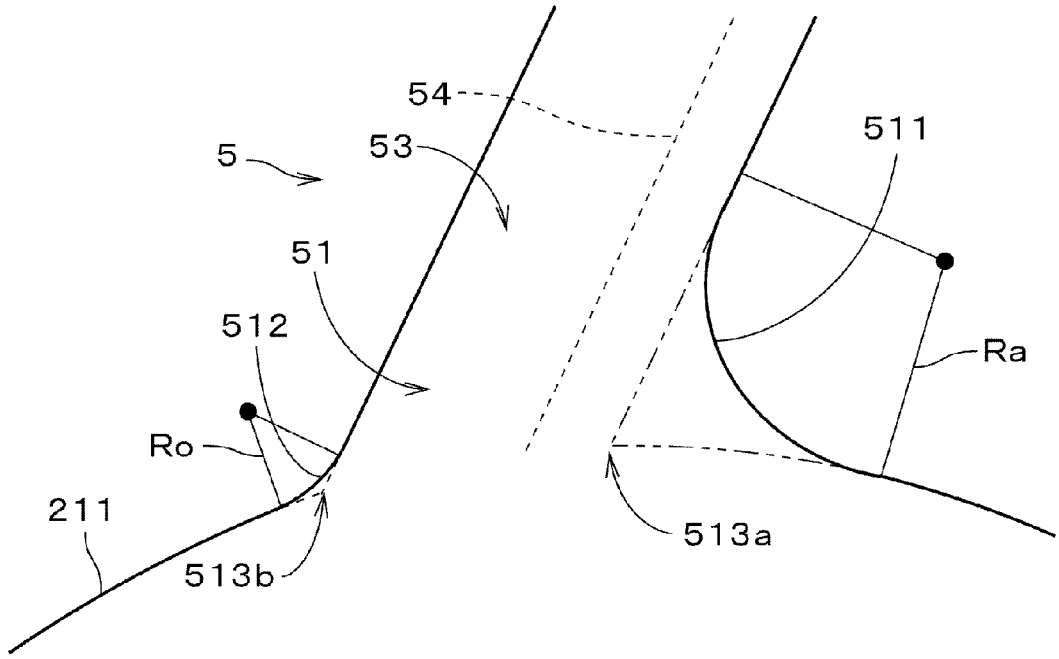
FIG. 4 is a schematic enlarged view showing the vicinity of an inner end portion of the supporting rib according to the first preferred embodiment of the present invention.

FIG. 4 is an enlarged view of the vicinity of the inner end portion 51 of the supporting rib 5 when viewed from the bottom side. The ridge line 54 arranged above the bottom face 53 of the supporting rib 5 is depicted by a dashed line. As shown in FIG. 4, the first and second corner portions 511 and 512 preferably include a shape which allows a region in the vicinity of the inner end portion 51 to be connected to the outer periphery of the base section 211. In other words, the first and second corner portions 511 and 512 are preferably provided in the inner end portion 51 so as to face an intersecting point 513*a* and an intersecting point 513*b* of lines obtained by virtually extending the edges of the supporting rib 5 (on the upstream side and the downstream side of the rotational direction of the impeller 3), and lines obtained by virtually extending the outer periphery of the base section 211, depicted by chain double-dashed lines.

As shown in FIG. 4, when viewed in a direction parallel to the center axis J1, the first and second corner portions 511 and 512 preferably are substantially arcuate, and they are concave toward the intersecting points 513*a* and 513*b*, respectively. That is, the edges of the first and second corner portions 511 and 512 opposed to the housing 4 are substantially arcuate and concave, respectively. The curvature radius Ro of the second corner portion 512 is preferably different from the curvature radius Ra of the first corner portion 511. In the present preferred embodiment, the curvature radius Ro of the second corner portion 512 is preferably smaller than the curvature radius Ra of the first corner portion 511.

Figure 5:
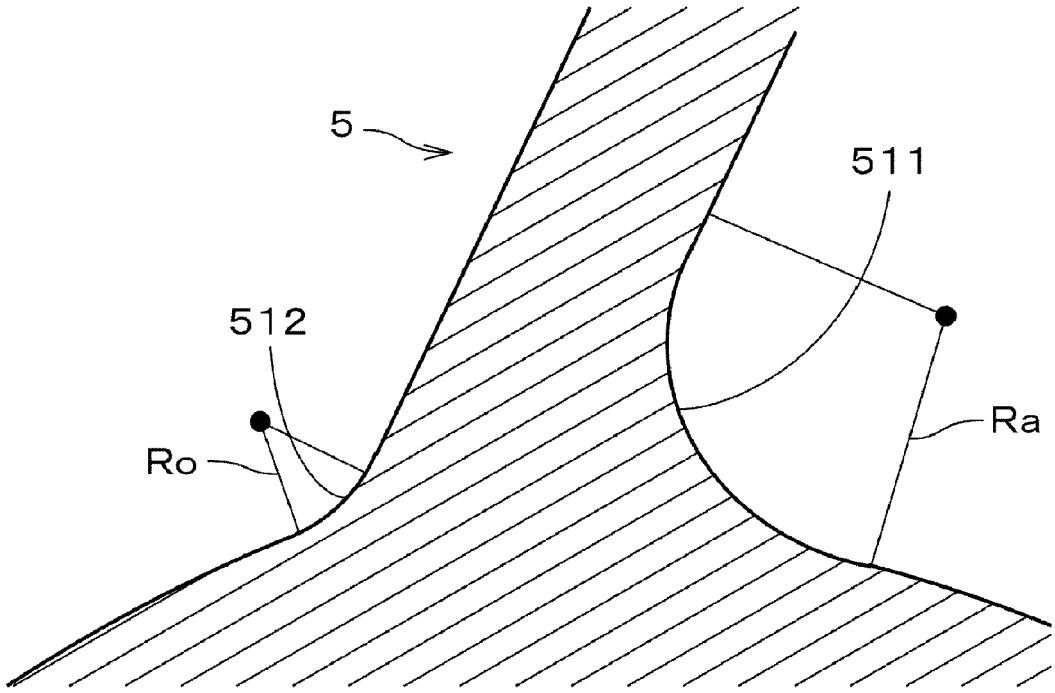
FIG. 5 is a schematic transverse sectional view of the vicinity of the inner end portion of the supporting rib according to the first preferred embodiment of the present invention.

FIG. 5 is a transverse cross-sectional view taken along the line B-B in FIG. 1. FIG. 5 shows the section in the substantially middle position in the axial direction of the inner end portion 51. As shown in FIG. 5, the first and second corner portions 511 and 512 have substantially the same horizontal cross-sectional shapes from the bottom face 53 (see FIG. 4) to the ridge line 54. The first and second corner portions 511 and 512 preferably are substantially arcuate and concave with the curvature radii Ra and Ro, respectively. The widths (the heights) of the first and second corner portions 511 and 512 in the direction along the center axis J1 are substantially the same as the widths (the heights) of the respective supporting rib 5 and the outer peripheral portion of the base section 211 in the direction along the center axis J1. As described above, in the present preferred embodiment, the curvature radius Ra is greater than the curvature radius Ro. Accordingly, the rigidity of the connecting portion between the supporting rib 5 and the base section 211 is increased, and the shock-resistance of the axial fan 1 is improved. In addition, the vibration caused in the motor section 2 is suppressed, and the vibration transmitted from the motor section 2 to the housing 4 can be efficiently suppressed. Preferably, the curvature radius Ra is approximately twice as large as, or greater than, the curvature radius Ro.

Figure 6:
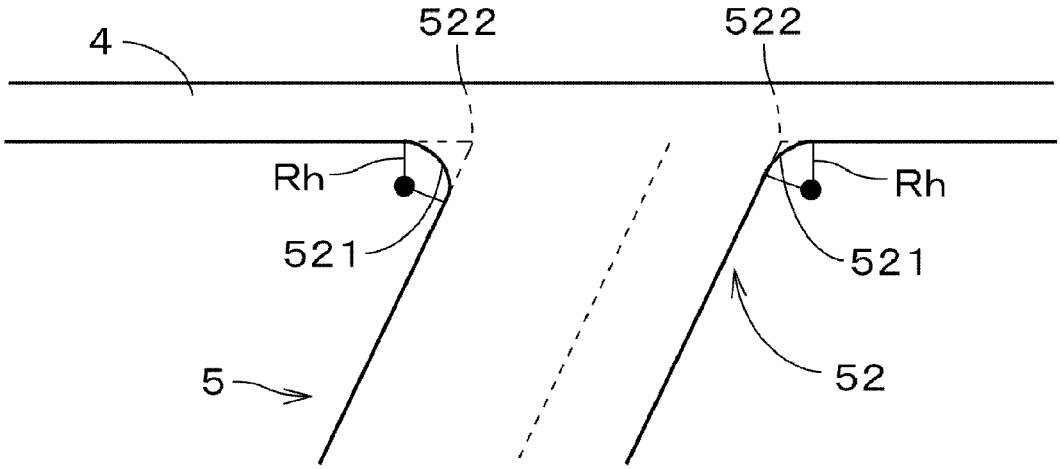
FIG. 6 is a schematic enlarged view showing the vicinity of an outer end portion of the supporting rib according to the first preferred embodiment of the present invention.

FIG. 6 is an enlarged view of the vicinity of the outer end portion 52 of the supporting rib 5. As shown in FIG. 6, in the outer end portion 52 of the supporting rib 5, the third corner portions 521 are formed on the side of the rotational direction of the impeller 3 (see FIG. 1) and on the side opposite to the rotational direction (i.e., on the downstream side and on the upstream side of the rotational direction), respectively. The third corner portions 521 preferably connect a region in the vicinity of the outer end portion 52 to the inner side face 41 of the housing 4. In other words, the third corner potions 521 face intersecting points 522 of lines obtained by virtually extending the edges of the supporting rib 5 (on the side of the rotational direction of the impeller 3 and the side opposite to the rotational direction), and obtained by virtually extending the inner side face 41, depicted by chain double-dashed lines. Accordingly, the air can smoothly flow around the supporting rib 5, so that the influence on various characteristics of the axial fan 1 (for example, the static pressure—air flow characteristic, the noise characteristic, and the like) can be minimized.

When viewed from the direction along the center axis J1, the inner edges of the respective third corner portions 521 are substantially arcuate and concave. The curvature radii Rh of the third corner portions 521 are preferably smaller than the curvature radius Ra of the first corner portion 511. Preferably, the curvature radii Rh are substantially equal to or greater than approximately 0.5 mm. By virtue of such configuration, the stress concentration can be avoided.

Figure 7:
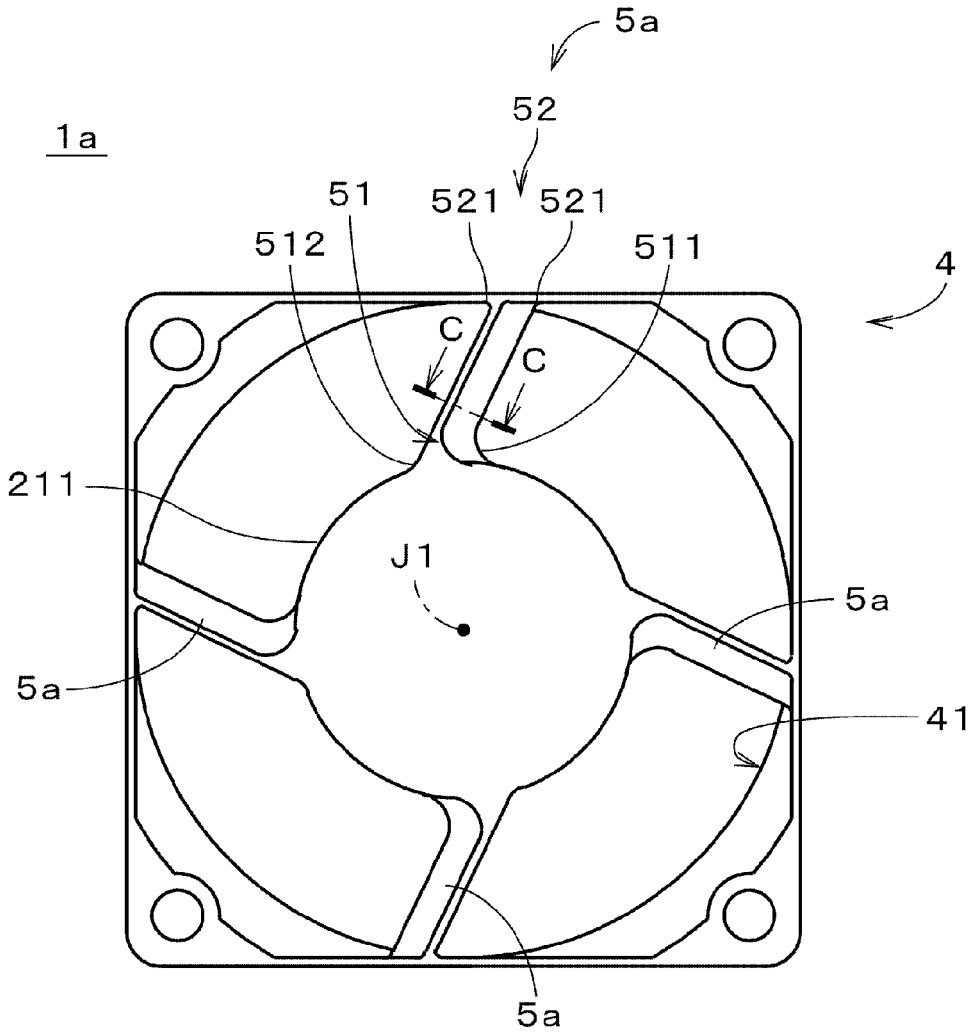
FIG. 7 is a schematic bottom plan view of an axial fan according to a second preferred embodiment of the preferred embodiment.

FIG. 7 is a bottom plan view of an axial fan 1*a* in a second preferred embodiment of the present invention. In the following description, the configurations similar to those described above will be designated by the same reference numerals. The axial fan 1*a* is different from the axial fan 1 in that the axial fan 1*a* preferably includes a plurality of supporting ribs 5*a* (in the present preferred embodiment, four supporting ribs 5*a*), but the other configurations are the same.

As shown in FIG. 7, the supporting ribs 5*a* are substantially flat-shaped stationary blade. Each of the supporting ribs 5*a* preferably includes an inner end portion 51 to connect to the base section 211. The supporting rib 5*a* preferably extends from an outer periphery of the base section 211 toward an inner side face 41 of the housing 4 and inclines to the side opposite to the rotational direction of the impeller 3 (see FIG. 1) with respect to the radial direction (i.e., in the clockwise direction in FIG. 7). In the vicinity of the inner end portion 51, a second corner portion 512 and a first corner portion 511 are preferably provided on the side of the rotational direction of the impeller 3 (on the downstream side) and on the side opposite to the rotational direction (on the upstream side), respectively.

Figure 8:
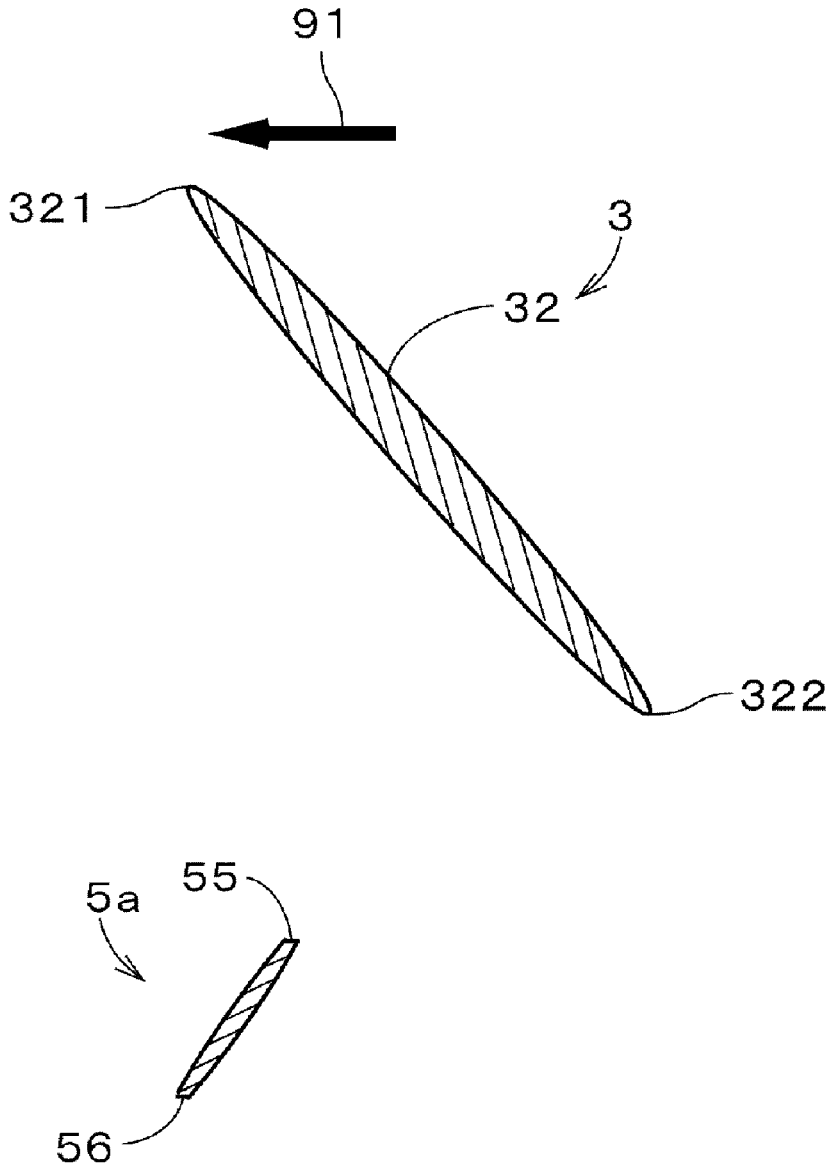
FIG. 8 is a schematic sectional view of a blade and a supporting rib according to the second preferred embodiment of the present invention.

FIG. 8 is a view showing a section of the supporting rib 5*a* and the blade 32 taken along the line C-C in FIG. 7 (i.e., a section perpendicular to the longitudinal direction of the supporting rib 5*a*). Similarly to the first preferred embodiment, the upper edge 321 of the blade 32 is preferably arranged further on the side of the rotational direction indicated by an arrow 91 than the lower edge 322. When the blade moves to the rotational direction, the air moves substantially downwards along the inclined blade surface in FIG. 8.

The supporting rib 5*a* having a substantially flat-shaped stationary blade shape preferably includes edges 55 and 56. The edge 55 is preferably provided on the side nearer to the impeller 3 as compared with the edge 56 in the direction along the center axis J1 (on the upper side of FIG. 8). Also, the edge 55 is preferably provided on the side opposite to the rotational direction of the impeller 3 as compared with the edge 56. The air generated from the blade 32 is preferably sent substantially downwards along the blade surface of the supporting rib 5*a*. By virtue of such configuration, the static pressure of the air exhausted from the axial fan 1*a* is improved.

Figure 9:
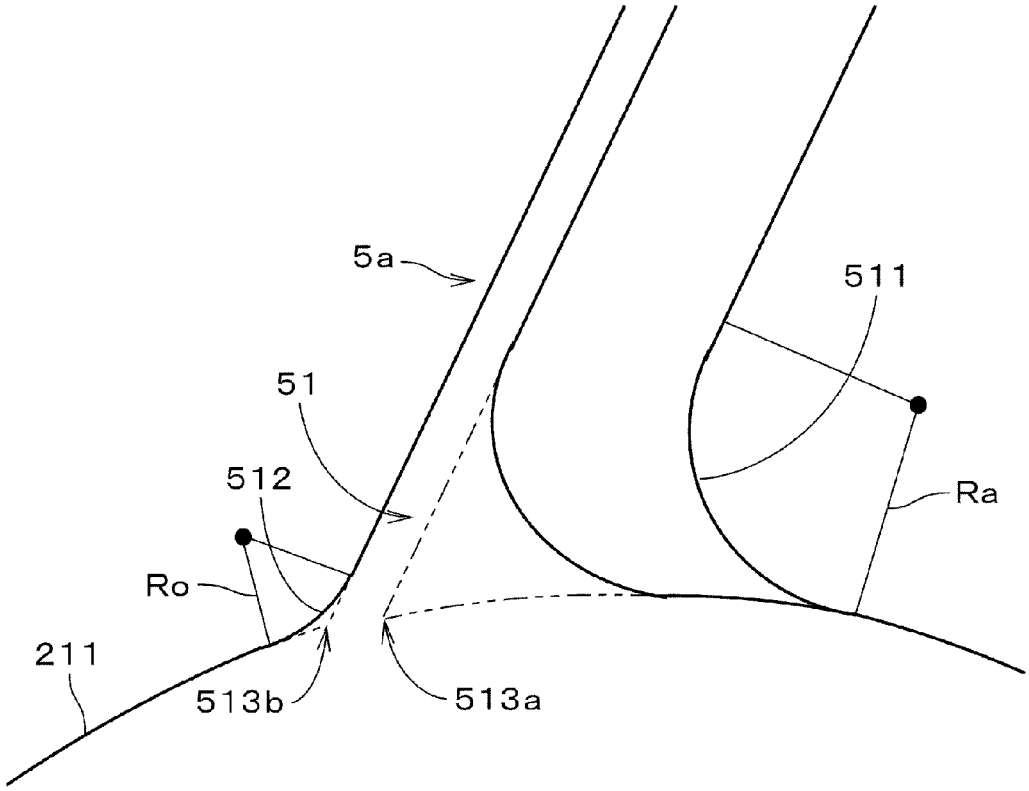
FIG. 9 is a schematic enlarged view showing the vicinity of an inner end portion of the supporting rib according to the second preferred embodiment of the present invention.

FIG. 9 is an enlarged view of the vicinity of the inner end portion 51 when viewed from the bottom side in the second preferred embodiment. The first and second corner portions 511 and 512 preferably include a shape for connecting which allows a region in the vicinity of the inner end portion 51 to be connected to the outer periphery of the base section 211. In other words, the first and second corner portions 511 and 512 are preferably provided so as to face intersecting points 513*a* and 513*b* of lines obtained by virtually extending the edges of the supporting rib 5*a* (on the upstream side and the downstream side of the rotational direction of the impeller 3) and obtained by virtually extending the outer periphery of the base section 211, depicted by chain double-dashed lines, respectively.

As shown in FIG. 9, when viewed in the direction parallel to the center axis J1, the edges of the first and second corner portions 511 and 512 opposite to the housing 4 preferably are substantially arcuate, and concave toward the intersecting points 513*a* and 513*b*. In the first and second corner portions 511 and 512, transverse sections thereof preferably include substantially the same shapes in any position in the direction along the center axis J1. The widths (heights) of the first and second corner portions 511 and 512 in the direction along the center axis J1 preferably are substantially the same as the height of the base section 211, and are smaller than the width (height) of the respective supporting rib 5*a* in the direction along the center axis J1. In the present preferred embodiment, the curvature radius Ra of the first corner portion 511 is preferably greater than the curvature radius Ro of the second corner portion 512. Preferably, the curvature radius Ra is approximately twice as large as, or greater than, the curvature radius Ro. Accordingly, the rigidity of the connecting region between the supporting rib 5*a* and the base section 211 is increased, and the shock-resistance of the axial fan 1*a* is improved. In addition, the vibration caused by the motor section 2 can be suppressed.

Figure 10:
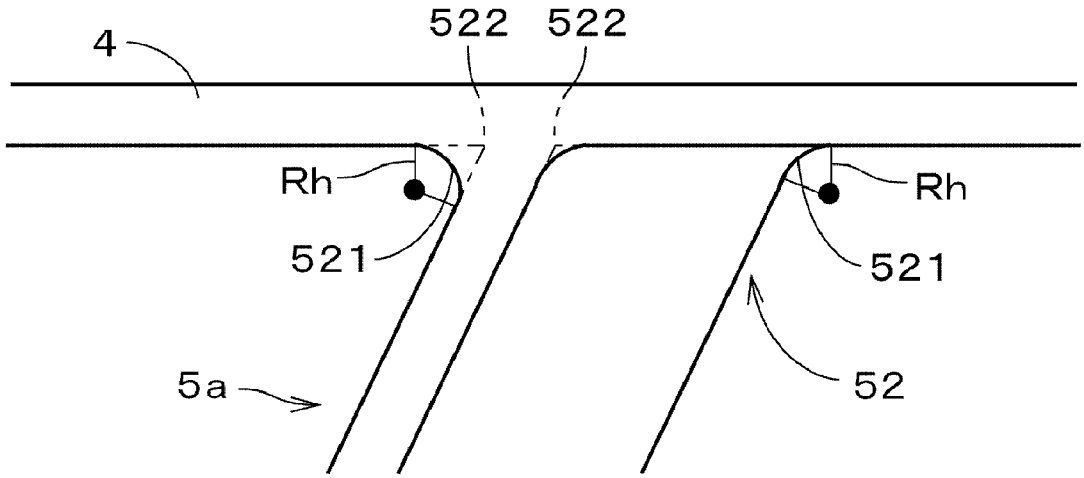
FIG. 10 is a schematic enlarged view showing the vicinity of an outer end portion of the supporting rib according to the second preferred embodiment of the present invention.

FIG. 10 is an enlarged view of the vicinity of the outer end portion 52 of the supporting rib 5 connected to the housing 4 in the second preferred embodiment. As shown in FIGS. 7 and 10, in the outer end portion 52, third corner portions 521 are preferably provided on the side of the rotational direction of the impeller 3 (see FIG. 1) and the side opposite to the rotational direction. The third corner portions 521 preferably include a shape which allows a region of the supporting rib 5*a* in the vicinity of the outer end portion 52 to be connected to the inner side face 41 of the housing 4. In other words, in FIG. 10, the third corner potions 521 face intersecting points 522 of lines obtained by virtually extending the edges of the supporting rib 5*a* (on the side of the rotational direction of the impeller 3 and the side opposite to the rotational direction), and obtained by virtually extending the inner side face 41 of the housing 4, depicted by chain double-dashed lines.

When viewed from the direction along the center axis J1, inner edges of the respective third corner portions 521 preferably are substantially arcuate and concave. The curvature radii Rh of the third corner portions 521 are preferably smaller than the curvature radius Ra of the first corner portion 511. Accordingly, the vibration transmitted from the motor section 2 to the housing 4 can be suppressed.

Figure 11:
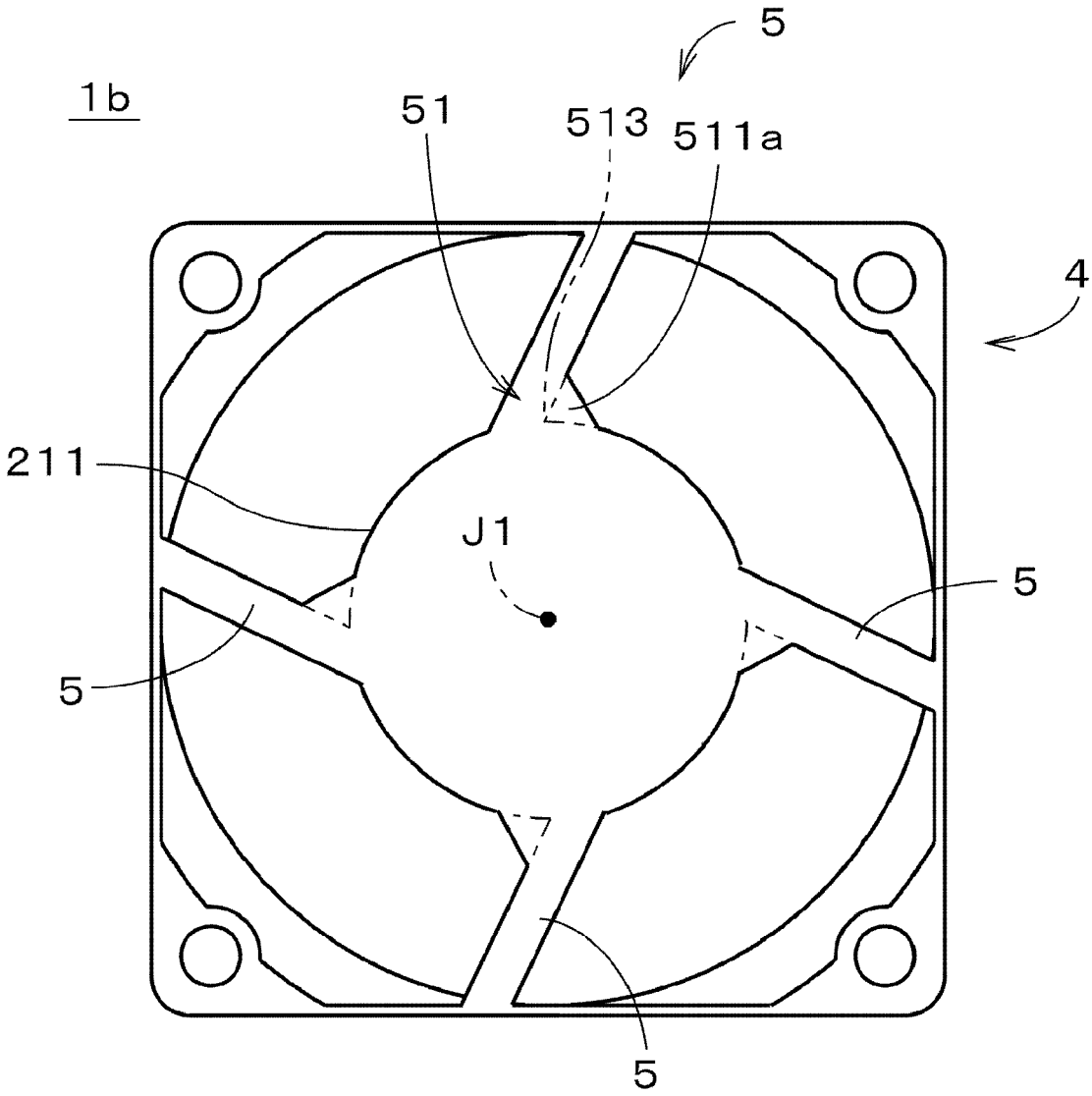
FIG. 11 is a schematic bottom plan view of an axial fan according to a third preferred embodiment of the present invention.

FIG. 11 is a bottom plan view of an axial fan 1*b* according to a third preferred embodiment of the present invention. The axial fan 1*b* is preferably different from the axial fan 1 shown in FIG. 2 in that the first corner portion has a different shape, and the sizes of the second and third corner portions are smaller than that of the first corner portion.

In the axial fan 1*b*, the angle of inclination in the inner end portion 51 of the supporting rib 5 with respect to the radial direction is preferably equal to or smaller than approximately 90 degrees, when the radial direction is regarded as 0 degree. In the case where the angle of inclination is approximately 90 degrees, the supporting rib 5 preferably corresponds to the tangent line of the base section 211.

In the inner end portion 51, the first corner portion 511*a* is preferably provided on the side opposite to the rotational direction of the impeller 3 (on the upstream side of the rotational direction). The first corner portion 511*a* preferably connects a region in the vicinity of the connecting position of the supporting rib 5 to the outer periphery of the base section 211. The edge of the first corner portion 511*a* opposed to the housing 4 is substantially linear. In other words, the first corner portion 511*a* is opposed to an intersecting point 513 of a line virtually extending the edge of the supporting rib 5 (on the side opposite to the rotational direction of the impeller 3) and a line virtually extending the outer periphery of the base section 211, depicted by chain double-dashed lines. Accordingly, the rigidity of the connection between the supporting rib 5 and the base section 211 is increased, and the shock-resistance of the supporting rib 5 is improved. Since the vibration of the motor section 2 is suppressed, the vibration characteristic of the axial fan 1*b* can be improved. The width of the first corner portion 511*a* in the direction along the center axis J1 is preferably equal to or smaller than the widths of the supporting rib 5 and the base section 211 in the direction along the center axis J1.

Figure 12:
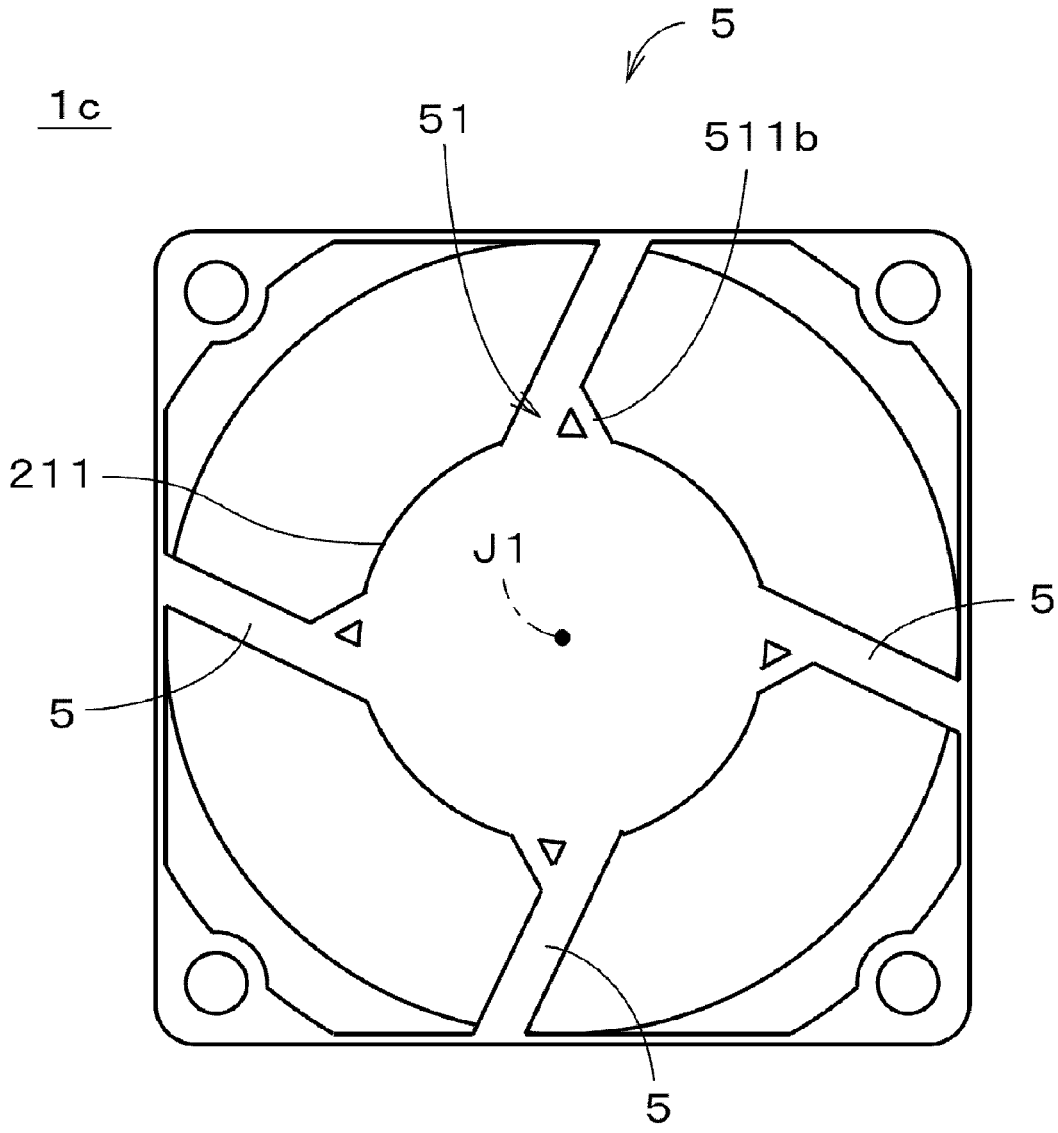
FIG. 12 is a schematic bottom plan view of an axial fan according to a fourth preferred embodiment of the present invention.

FIG. 12 is a bottom plan view of an axial fan 1*c* according to a fourth preferred embodiment of the present invention. The axial fan 1*c* is different from the axial fan 1*b* shown in FIG. 11 in the shape of the first corner portion.

In the axial fan 1*c*, the angle of inclination at the inner end portion 51 of the supporting rib 5 with respect to the radial direction preferably is substantially equal to or smaller than approximately 90 degrees, when the radial direction is regarded as 0 degree. A first corner portion 511*b* disposed in the supporting rib 5 preferably includes a bar-shape. One end of the first corner portion 511*b* is preferably connected to an edge of the inner end portion 51 on the side opposite to the rotational direction of the impeller 3 (see FIG. 1) (i.e., on the upstream side), and the other end thereof is preferably connected to an outer periphery of the base section 211. That is, the first corner portion 511*b* preferably includes such a shape that a through hole is provided in a direction substantially parallel to the center axis J1 in the first corner portion 511*a* shown in FIG. 11. Accordingly, the rigidity of the connection between the supporting rib 5 and the base section 211 is increased, and the shock-resistance thereof is improved. Moreover, the vibration of the motor section 2 is suppressed, and the vibration characteristics of the axial fan 1*c* will be improved.

Figure 13:
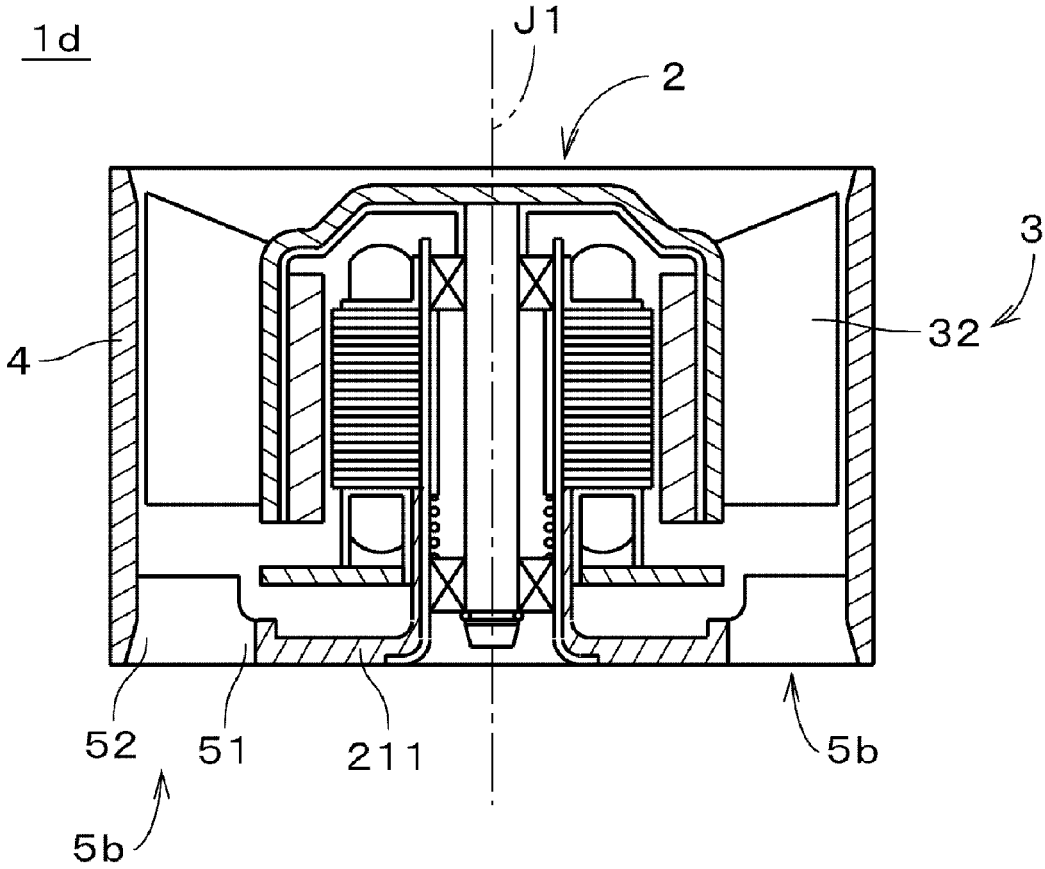
FIG. 13 is a schematic longitudinal sectional view of an axial fan according to a fifth preferred embodiment of the present invention.

FIG. 13 is a longitudinal sectional view of an axial fan id according to a fifth preferred embodiment of the present invention. The axial fan id preferably includes a motor section 2, an impeller 3, a housing 4, and a plurality of supporting ribs 5*b* (four supporting ribs in the present preferred embodiment), similarly to the axial fan 1. The base section 211 of the motor section 2, the housing 4, and the supporting ribs 5*b* preferably are integrally formed by injection molding with a resin, for example. Also, they may be formed by die-casting using aluminum, aluminum alloy, or the like. With such a configuration, the increase in number of components of the axial fan 1*d* can be suppressed, and the increase in production cost can be minimized. Each of the supporting ribs 5*b* is a substantially flat-shaped stationary blade, similarly to the supporting rib 5*a* shown in FIGS. 7 to 10. Accordingly, the static pressure of the air exhausted from the axial fan 1*d* can be increased.

The inner end portion 51 of the supporting rib 5*b* is preferably connected to the base section 211. In the inner end portion 51, a first corner portion is preferably arranged on the side opposite to the rotational direction of the impeller 3 (i.e., on the upstream side of the rotational direction). In the first corner portion, an angle defined by the supporting rib 5*b* and the base section 211 is preferably an acute angle. On the other hand, a second corner portion is preferably arranged in the inner end portion 51 on the side of the rotational direction of the impeller 3 (i.e., on the downstream side of the rotational direction). In the second corner portion, an angle defined by the supporting rib 5*b* and the base section 211 is preferably an obtuse angle (see FIG. 9). An outer end portion 52 of the supporting rib 5*b* is preferably connected to the housing 4. In addition, in the connecting region, third corner portions are preferably arranged on the side of the rotational direction of the impeller 3 and on the side opposite to the rotational direction, respectively (see FIG. 10).

Figure 14:
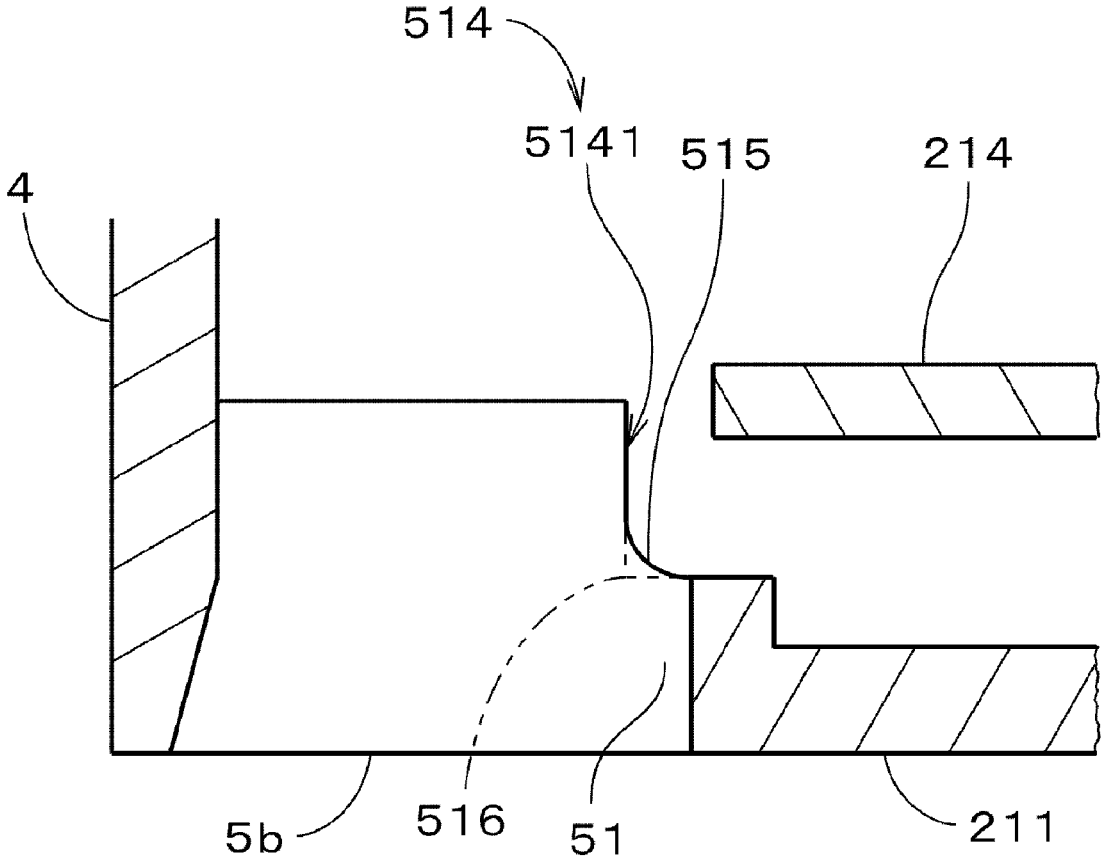
FIG. 14 is a schematic view showing a supporting rib according to the fifth preferred embodiment of the present invention.
Figure 15:
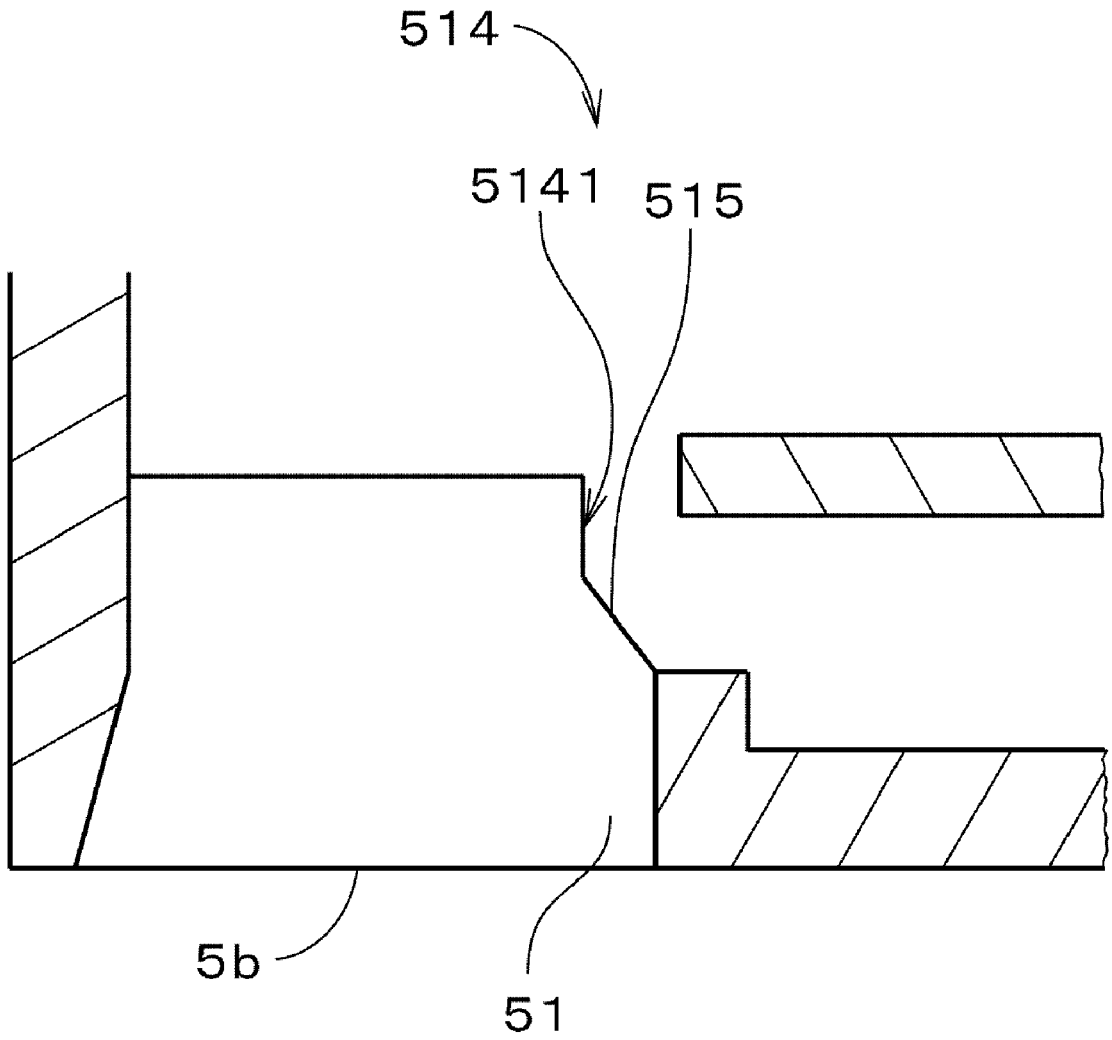
FIG. 15 is a schematic view showing the supporting rib according to the fifth preferred embodiment of the present invention.

FIG. 14 is an enlarged view of the vicinity of the supporting rib 5*b* shown on the left side with respect to the center axis J1 in FIG. 13. In a region of the supporting rib 5*b* in the vicinity of the base section 211, a stepped portion 514 is formed. In the stepped portion 514, the height of the supporting rib 5*b* in the direction along the center axis J1 is preferably lowered toward the side of the base section 211. In other words, the stepped portion 514 preferably functions as a boundary between the inner end portion 51 of the supporting rib 5*b* and the other regions. In the direction along the center axis J1, a lower edge of the supporting rib 5*b* and a lower surface of the base section 211 are substantially at the same level. That is, the width of the inner end portion 51 of the supporting rib 5*b* in the direction along the center axis J1 decreases as the distance from the impeller 3 in the direction along the center axis J1 increases, as compared with the other regions of the supporting rib 5*b*. Accordingly, a gap is formed between the supporting rib 5*b* and the circuit board 214 of the motor section 2 (see FIG. 13), so that that contact between the supporting rib 5*b* and the circuit board 214 can be prevented.

As shown in FIGS. 13 and 14, in the vicinity of the stepped portion 514, an upper corner portion 515 is preferably provided on the upper side of the inner end portion 51 of the supporting rib 5*b*, and positioned between the edge of the inner end portion 51 on the side of the impeller 3 and the other regions. When viewed from the axial direction, the upper corner portion 515 is substantially arcuate and concave toward the lower left of FIG. 14 (on the side of the housing 4 and on the lower side). In other words, the inner end portion 51 is preferably opposed to an intersecting point 516 of lines depicted by chain double-dashed lines and obtained by virtually extending an edge 5141 of the stepped portion 514 downwards on the side of the center axis J1 and virtually extending an upper edge of the outer periphery of the base section 211, as shown in FIG. 14. The widths of the first and second corner portions (see FIG. 9) in the direction along the center axis J1 are substantially equal to the width of the outer peripheral portion of the base section 211, and are preferably smaller than the width of the supporting rib 5*b* in the direction along the center axis J1. Accordingly, the rigidity between the supporting rib 5*b* and the base section 211 is further increased, the vibration of the motor section 2 can be suppressed, and the vibration characteristic of the axial fan 1*d* can be improved.

The shape of the upper corner portion 515 is not limited to the above-described one, for example, the upper corner portion 515 may have other shapes. For example, as shown in an enlarged view of the supporting rib 5*b* of FIG. 15, the upper corner portion 515 may have such a shape that the edge 5141 of the stepped portion 514 on the side of the center axis J1 is preferably connected to the upper portion of the inner end portion 51, and the inner edge may be an inclined face of a planer or curved shape. In the fifth preferred embodiment, the first corner portion may be omitted, and only the upper corner portion 515 may be adopted. In this case, the rigidity between the supporting rib 5*b* and the base section 211 can be increased, the vibration of the motor section 2 can be suppressed, and the vibration characteristic of the axial fan 1*d* can be improved.

In the respective preferred embodiments, the number and the sectional configuration of the supporting ribs are not specifically limited. The sectional configuration of the respective supporting rib may be a substantially circular shape, a substantially polygonal shape, or a substantially blade shape, other than the substantially triangular or substantially flat-shaped stationary blade shape. In addition, in an arbitrary position in the direction along the center axis J1, the curvature radius Ra may not be limited to be constant. It is sufficient that the first corner portion 511 may have such a shape that an average of the curvature radius Ra in the direction along the center axis J1 is different from an average of the curvature radius Ro of the second corner portion 512. Alternatively, the first corner portion 511 may have other shapes. Moreover, the average of the curvature radius Ra in the direction along the center axis J1 is preferably greater than the average of the curvature radius Ro of the second corner portion 512.

The width of the first corer portion in the direction along the center axis J1 is not specifically limited, but is preferably equal to or smaller than the widths of the supporting rib and the base section 211 in the direction along the center axis J1. Accordingly, the suppression of vibration can be realized without unnecessarily increasing the volume of the first corner portion.

In the above-mentioned preferred embodiments, the molding of the supporting ribs, the housing 4, and the base section 211 may not be limited to the injection molding with a synthetic resin. For example, they may be formed by die-casting using aluminum, aluminum alloy, or the like.

The axial fan 1 is used mainly as a cooling fan for air-cooling the electronic equipment such as servers, but the application thereof may not be specifically limited. The application of the axial fans 1 to 1*d* may not be limited to cooling fans for electronic equipment, but they may be used for other applications.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A frame for an axial fan comprising:

a housing arranged to accommodate an impeller;

a base section disposed on an inside of the housing; and supporting ribs extending from the base section to the housing to support the base section, the supporting ribs being disposed on the inside of the housing; wherein in a connecting region between each of the supporting ribs and the base section:

a first corner portion and a second corner portion are arranged on an upstream side and on a downstream side of a rotational direction of the impeller, respectively; and a curvature radius of the first corner portion is different from a curvature radius of the second corner portion; and each and every one of the supporting ribs inside of the housing has substantially the same shape and substantially the same dimensions such that all of the first corner portions have substantially identical curvature radii and all of the second corner portions have substantially identical curvature radii.

2. The frame for an axial fan according to claim 1, wherein the curvature radius of the second corner portion is smaller than the curvature radius of the first corner portion.

3. The frame for an axial fan according to claim 1, wherein the supporting ribs are angled with respect to a radial direction extending from a center axis of the base section.

4. The frame for an axial fan according to claim 1, wherein the first and second corner portions are substantially arcuate and concave.

5. The frame for an axial fan according to claim 1, wherein the curvature radius of the first corner portion is twice or more as large as the curvature radius of the second corner portion.

6. The frame for an axial fan according to claim 1, wherein in the connecting region between the supporting ribs and the housing, third corner portions are arranged on the upstream side and on the downstream side of the rotational direction of the impeller, respectively, the third corner portions having curvature radii smaller than the curvature radius of the first corner portion.

7. The frame for an axial fan according to claim 6, wherein the third corner portions are substantially arcuate and concave.

8. The frame for an axial fan according to claim 1, wherein the first corner portion includes an edge opposed to the housing.

9. The frame for an axial fan according to claim 8, wherein the edge is substantially linear.

10. The frame for an axial fan according to claim 1, wherein the first corner portion is a substantially elongated member arranged to connect the supporting ribs to the base section.

11. The frame for an axial fan according to claim 1, wherein the supporting ribs are a substantially flat stationary blade.

12. The frame for an axial fan according to claim 11, wherein the supporting ribs include at least an upper edge and a lower edge.

13. The frame for an axial fan according to claim 1, wherein a width of the connecting region between the supporting ribs and the base section is narrower than widths of other regions of the supporting ribs.

14. The frame for an axial fan according to claim 13, wherein the connecting region between the supporting ribs and the base section is substantially arcuate and concave.

15. The frame for an axial fan according to claim 13, wherein the connecting region between the supporting ribs and the base section include an inclined surface.

16. The frame for an axial fan according to claim 1, wherein the housing, the base section, and the supporting ribs are a single, unitary member.

17. The frame for an axial fan according to claim 1, wherein a width of the first corner portion is equal to or less than widths of the supporting ribs and the base section.

18. An axial fan comprising:

a housing;

a base section disposed on an inside of the housing;

a plurality of supporting ribs extending from the base section to the housing to support the base section, the plurality of supporting ribs being disposed on the inside of the housing;

an impeller disposed on the inside of the housing; and a motor section, supported by the base section, arranged to rotationally drive the impeller; wherein in a connecting portion between each of the plurality of supporting ribs and the base section, a first corner portion and a second corner portion are arranged on an upstream side and on a downstream side in a rotational direction of the impeller, respectively;

a curvature radius of the second corner portion is smaller than a curvature radius of the first corner portion; and each and every one of the plurality of supporting ribs inside of the housing has substantially the same shape and substantially the same dimensions such that all of the first corner portions have substantially identical curvature radii and all of the second corner portions have substantially identical curvature radii.

19. The axial fan according to claim 18, wherein the plurality of supporting ribs are angled on the downstream side of the rotational direction of the impeller.

20. The axial fan according to claim 18, wherein each of the plurality of supporting ribs includes a substantially flat stationary blade, and an edge of the plurality of supporting ribs on a side of the impeller is positioned on the downstream side of the rotational direction of the impeller as compared with an edge on the side opposite to the impeller.

* * * * *